US006206542B1

(12) United States Patent
Case et al.

(10) Patent No.: US 6,206,542 B1
(45) Date of Patent: Mar. 27, 2001

(54) FLASHLIGHT SUPPORT DEVICE

(75) Inventors: Richard N. Case; Howard Steve Ellenburg, both of Boulder, CO (US)

(73) Assignee: RCP Enterprises, Inc., Boulder, CO (US)

( * ) Notice: Subject to any disclaimer, the term of this patent is extended or adjusted under 35 U.S.C. 154(b) by 0 days.

(21) Appl. No.: 09/332,201

(22) Filed: Jun. 11, 1999

(51) Int. Cl.[7] ..... F21P 1/02

(52) U.S. Cl. ..... 362/190; 362/191; 362/208; 362/388; 362/382; 362/418; 362/197; 362/198

(58) Field of Search ..... 362/190, 191, 362/208, 389, 382, 418, 197, 198

(56) References Cited

U.S. PATENT DOCUMENTS

| | | | |
|---|---|---|---|
| 2,707,228 | 4/1955 | Philipson | 362/287 |
| 4,739,457 | 4/1988 | Orr | 362/287 |
| 4,897,768 | 1/1990 | Thul | 369/191 |
| 5,016,148 | 5/1991 | Kohm | 362/102 |
| 5,188,450 | 2/1993 | Anderson | 362/194 |
| 5,608,919 | 3/1997 | Case | 362/104 |
| 5,743,623 | 4/1998 | Kerr | 362/190 |
| 5,931,560 * | 8/1999 | Hoffman | 362/124 |

* cited by examiner

*Primary Examiner*—Sandra O'Shea
*Assistant Examiner*—Anabel M Ton
(74) *Attorney, Agent, or Firm*—Donald W. Margolis

(57) ABSTRACT

A flashlight support device having a hollow open body that has at least one open end and is designed to removably fit over the body of a flashlight. Attached in substantially diametric opposition adjacent to one open end is at least one pair of separate legs for rotation in the Y-axis. Each leg is comprised of a bendable material and is capable of being bent, without any additional mechanism, into substantially any position and configuration in the X and Z-axis. A rotation mechanism and the adjustable and bendable legs attached thereto allows each rotatable and bendable leg to be rotated into a number of incremental positions in the Y-axis over a range of a full 360°. In preferred embodiments, the flashlight support device has two opposed open ends, and there are at least two pairs of adjustable and bendable legs attached to the hollow body for rotation in the Y-axis.

19 Claims, 15 Drawing Sheets

FLASHLIGHT SUPPORT DEVICE

BACKGROUND OF THE INVENTION a. Field of the Invention

The present invention relates to a support device for a self-powered illumination device. More specifically, it relates to a support and mounting device for a flashlight, which allows a flashlight carried by the device to be positioned to illuminate a desired area.

b. Discussion of the Prior Art

Heretofore, illuminating device supports encompassed many various designs, including wire racks, stationary tripods, stationary two legged supports, magnets, clamps, wire rings, and many other support configurations. U.S. Pat. No. 4,739,457 discloses a hands free illuminating device support having an adjustable light reflector. The support device allows an illuminating device to be prepositioned in a supported or suspended orientation. The support device is comprised of flanges attached to either side of the illuminating device casing and extending downward, terminating in a flange bottom edge. The flanges are configured to receive and latch the reflector into a stored position. Each flange also has a rotor shaft bearing to rotatably receive a rotor shaft on a Z-axis to the flange. This allows the rotor and a rigid leg attached to the rotor to have 360° of Z-axis rotation. The rotor has a rotor shaft and leg shaft bearings which rotatably receive the leg shaft on a Y axis to the flange, thereby providing the leg with about 180° of Y-axis rotation to the flange. The rigid legs have a leg shaft on one end and a hooking means on the opposite end. This allows the legs to be rotated, as required to accommodate the device to various detent positions on the Y and Z-axes to provide prepositioned support or suspension for the illuminating device held by the support device.

U.S. Pat. No. 5,743,623 shows a clip on support for a flashlight. U.S. Pat. No. 5,608,919shows a flashlight retainer that is flexible and has hooks for attaching it to a support. U.S. Pat. No. 5,016,148 teaches a flexible attached sleeve with support for a flashlight.

A commercially available product sold under the trademark "BENDYLIGHTS" has been found on sale during the week of Jun. 6, 1999. It consists of a cylindrical C-battery flashlight which is decorated with sunglasses/eyes on the head of the flashlight. It also includes a pair of bendable arms and legs in the form of caricature arms and legs, including an embedded bendable wire extending through each arm and leg. One wire joins both legs. One wire joins both arms. In both cases, the joining wires extend through the body of the flashlight and around the batteries. The BENDYLIGHTS products are integral with the body of the flashlight, and are not removable from the body of the flashlight.

None of the known prior art provides a simple device for supporting and mounting a flashlight, which device includes bendable appendages which are simply and easily rotated in the Y-axis and bendable in the X and Z-axis in order to allow a flashlight carried by the device to be positioned to illuminate a desired area

SUMMARY OF THE INVENTION

It is an object of this invention to provide a flashlight support device which may be prepositioned or repositioned to illuminate a desired area in a manner such that the device need not be hand held, thereby leaving the hands of a user free.

It is another object of this invention to provide such a flashlight support device having a single rotor mechanism and bendable appendages in order to reduce manufacturing costs.

It is also an object of this invention to provide such a support device of such diverse capability, and having bendable appendages so that a flashlight carried by the device may be supported, suspended or hung in almost ang position, regardless of the configuration or orientation of the area in which it is to be used, thereby increasing the utility of the flashlight carried by the device.

It is a further object of this invention to provide such a support device that is of such size and configuration that it offers no interference and does not add substantially to the size of the flashlight when it is hand held by a user.

It is still another object of the present invention to provide a support device for a flashlight that is of simple but rugged design, and which, at the same time, is very easy to operate.

These and other objects are provided by a flashlight support device having a hollow open body. The hollow open body has at least one open end and is designed and dimensioned to removably fit over the body of a flashlight. There is at least one pair of adjustable and bendable legs attached to the hollow body for rotation in the Y-axis. Each pair of adjustable and bendable legs is located in substantially diametric opposition adjacent to one open end of the hollow open body. Each leg is comprised of a bendable material and is capable of being bent, without any additional mechanism, into substantially any position and configurations in the X and Z-axis. A rotation mechanism and the adjustable and bendable legs attached thereto allows each rotatable and bendable leg to be rotated into a number of incremental positions, over a range of a full 360°. In preferred embodiments, the flashlight support device has two opposed open ends, and there are at least two pairs of adjustable and bendable legs attached to the hollow body by rotation means for rotation in the Y-axis and located in substantially diametric opposition to one another.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE INVENTION

Figure 1:
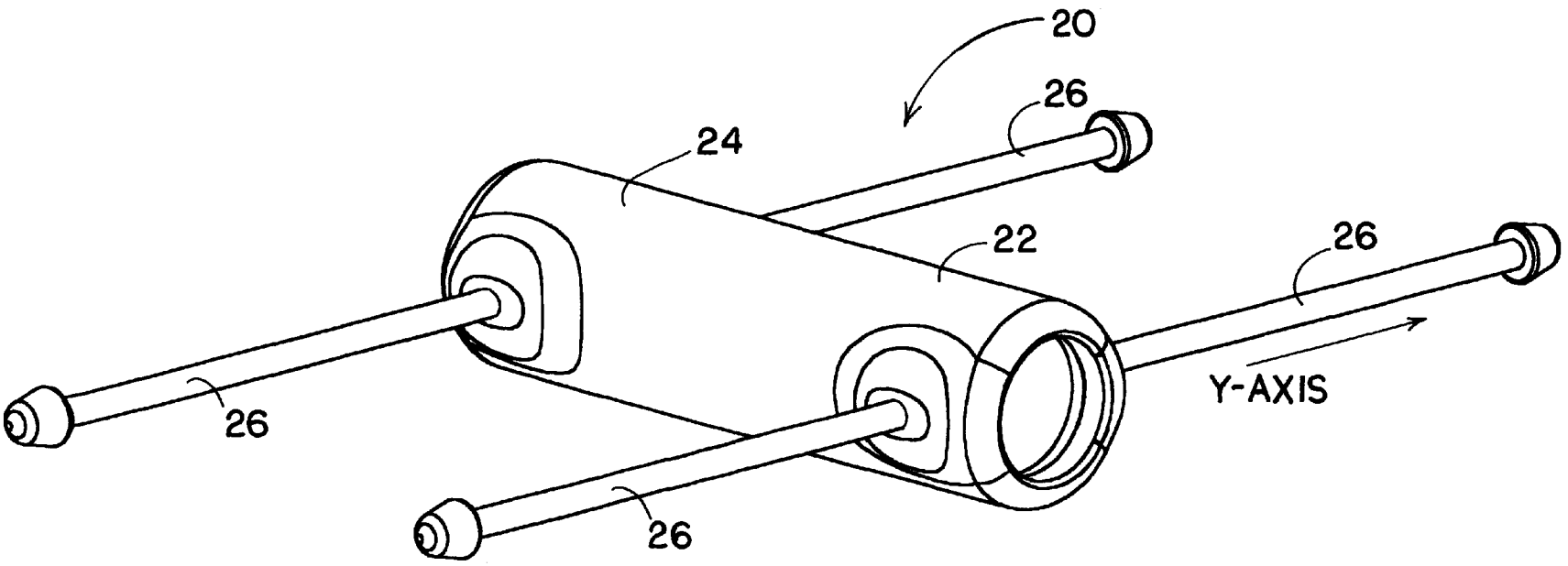
FIG. 1 shows a perspective view of the flashlight support device of the present invention with its four legs straight and extended.
Figure 2:
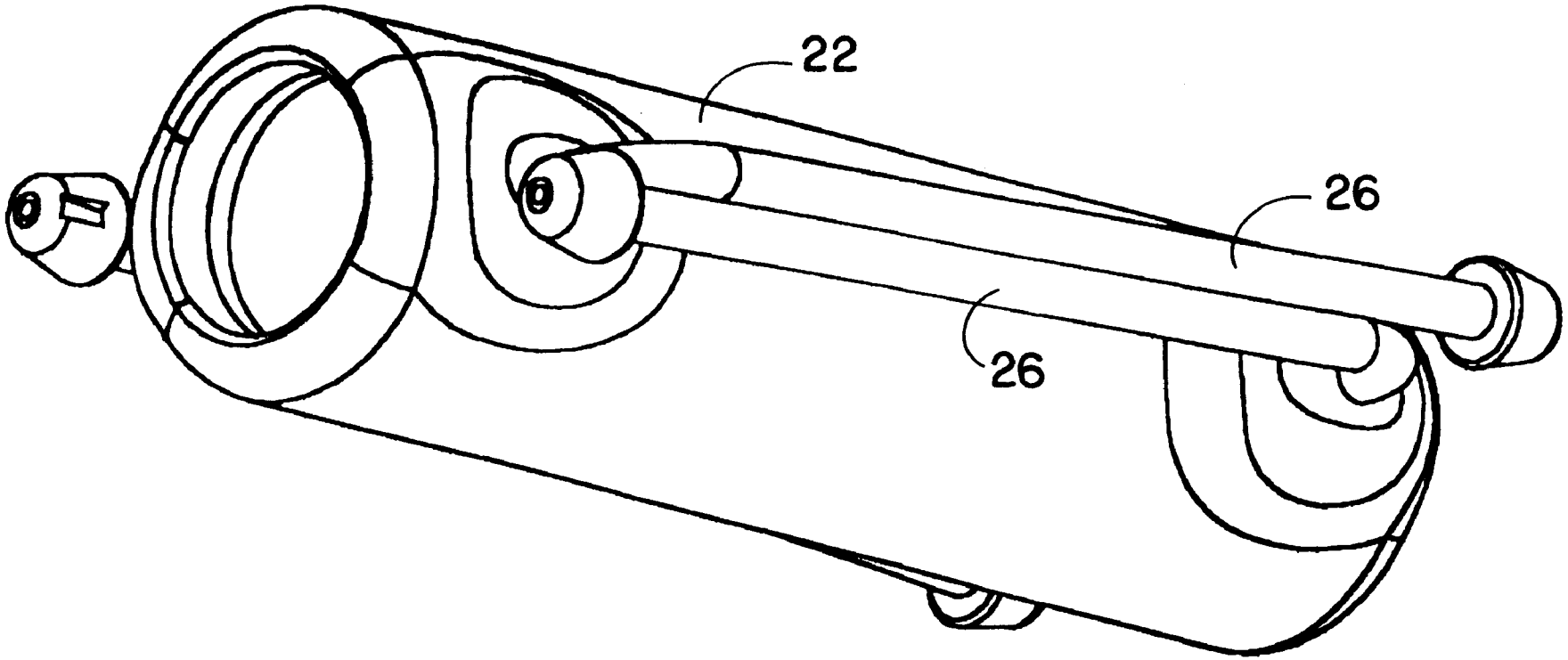
FIG. 2 shows a perspective view of the flashlight support device of FIG. 1 with its legs folded against the body and in repose.
Figure 3:
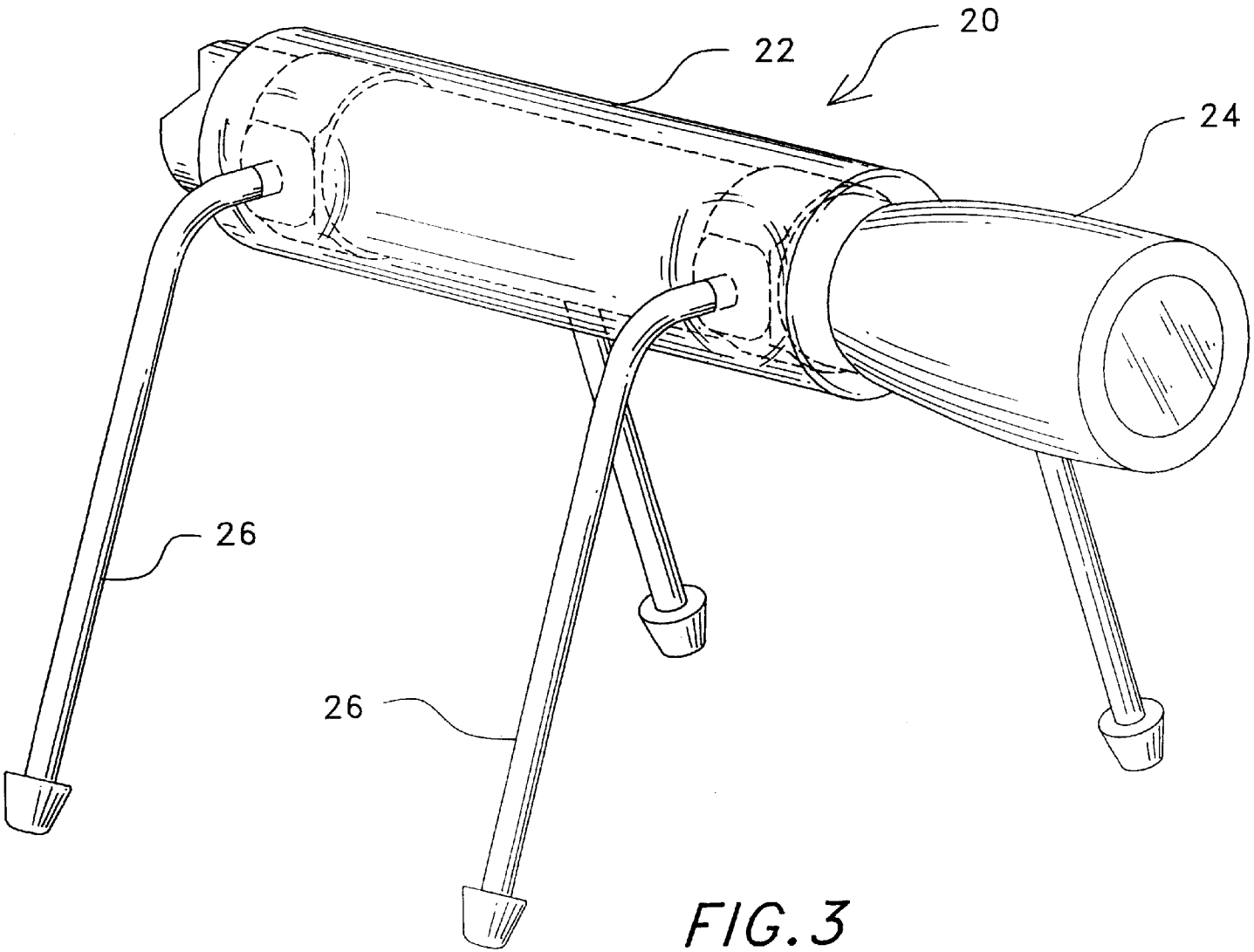
FIG. 3. shows a perspective view of the flashlight support device of the present invention in one of its many possible support orientations, and carrying a flashlight.

Referring now to FIGS. 1–4, the flashlight support device, generally 20, of the present invention, is shown. Flashlight support device 20 includes a hollow, substantially cylindrical body or sleeve 22. It is designed and dimensioned to removably fit over the cylindrical barrel of a hand held flashlight 24, although other shapes and sizes may be used to accommodate flashlights having other shapes and sizes. Hollow cylindrical body 22 carries at least two adjustable legs or appendages 26, although in the embodiments shown in FIGS. 1–4 and 9*a*–9*g*, and 10–12 it is shown carrying four rotatable and adjustable bendable legs 26. As shown in FIG. 1, flashlight support device 20 is in the position and configuration that it will normally have when it is first produced, with two (2) pairs of straight legs 26 permanently, rotatably attached to sleeve 22 in a manner which is detailed below. A first pair of bendable legs 26 is located substantially adjacent to one open end of hollow, cylindrical sleeve 22 and diametrically opposed to each other, each leg being incrementally rotatably in the Y-axis using one of the mechanisms described below. A second pair of bendable legs 26 is located substantially adjacent to the other open end of hollow sleeve 22 and diametrically opposed to each other, again with each leg being incrementally rotatable in the Y-axis.

The flashlight support device of the present invention may have each rotatable and bendable leg 26 rotated into a number of incremental positions over a range of a full 360° in the Y-axis, and bent, without any additional mechanism, into substantially any position and configurations in the X and Z-axis. Representative examples of which, configurations are detailed below with reference to FIGS. 2, 3 and 9*a*–9*g*. Now referring to FIG. 2, there is shown a perspective view of the flashlight support device 20 in repose, with all four legs 26 rotated and bent substantially parallel to cylindrical body 22, this being the position in which device 20 will have legs 26 oriented when device 20 and flashlight 24 are being hand held or stored in a minimum of space. The friendly position shown in FIG. 3 has all four legs 26 positioned in the same configuration and attitude so that a beam of light from flashlight 24 would be substantially parallel to the surface on which flashlight support device 20 is resting.

Figure 4:
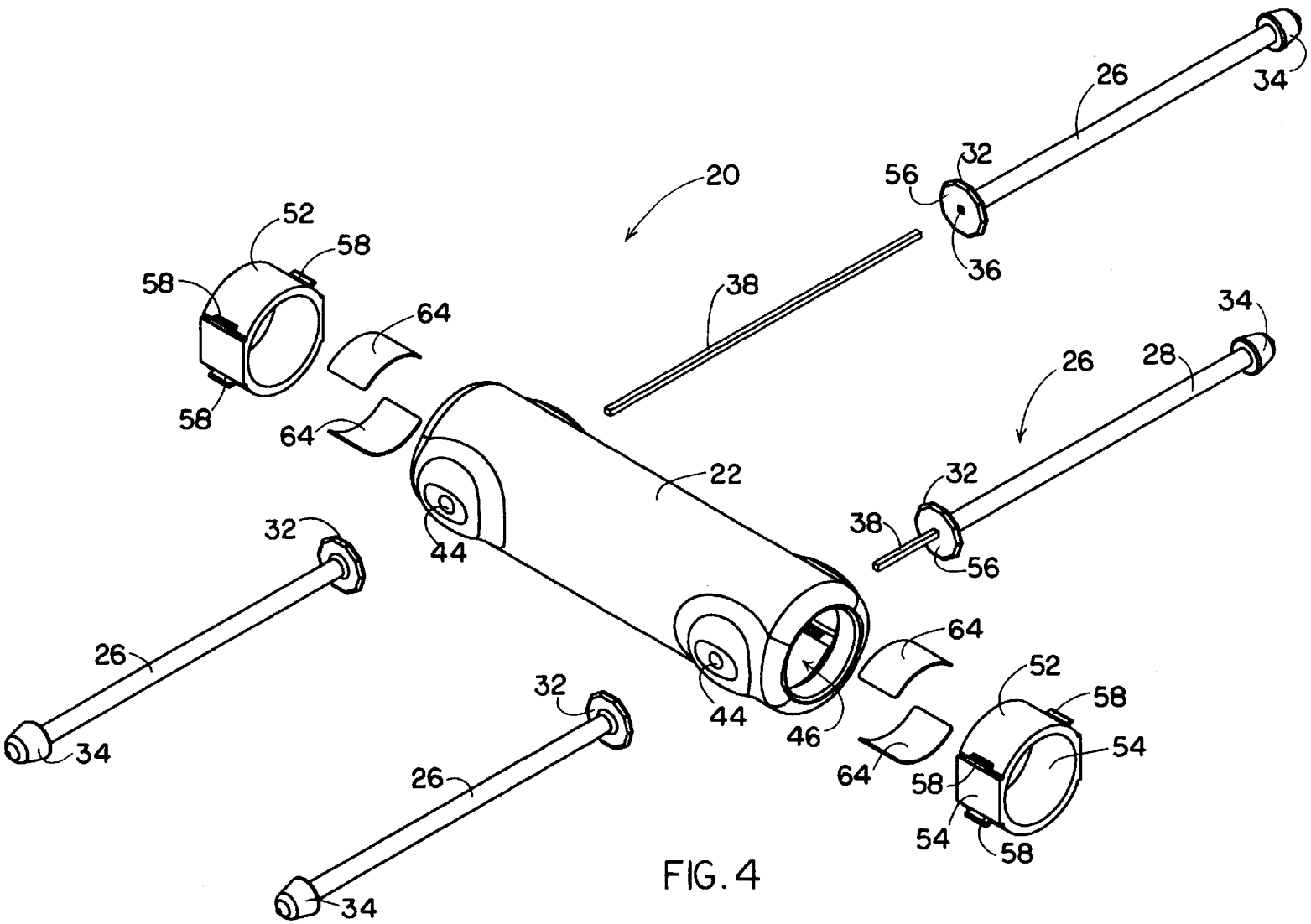
FIG. 4 shows a perspective view of the flashlight support device of FIG. 3 disassembled in an exploded view showing how the components fit together.
Figure 5:
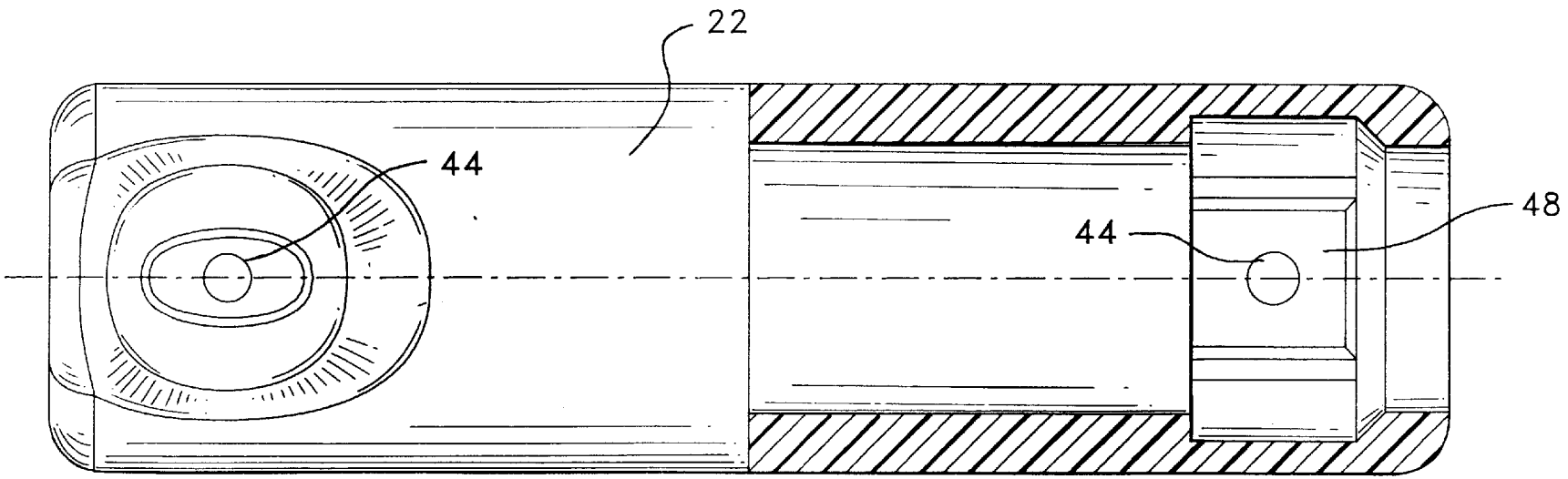
FIG. 5 is a front elevational view of the cylindrical body of the flashlight support of the present invention, shown partially in cross section.
Figure 6:
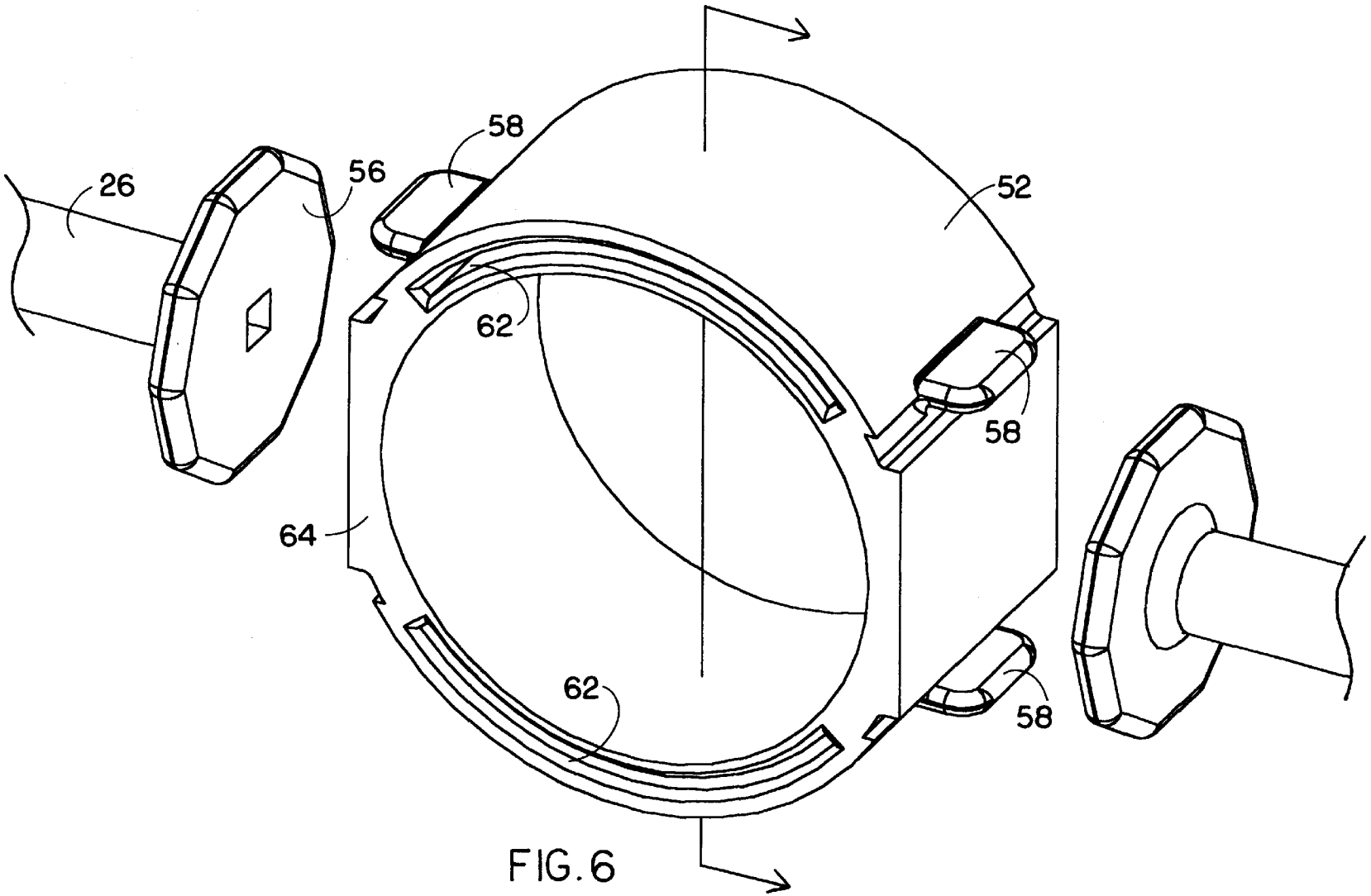
FIG. 6 is a perspective exploded view showing how the polygonal base of each leg relates to a support collar which will be located within the hollow cylindrical body of the flashlight support of the present invention.
Figure 7:
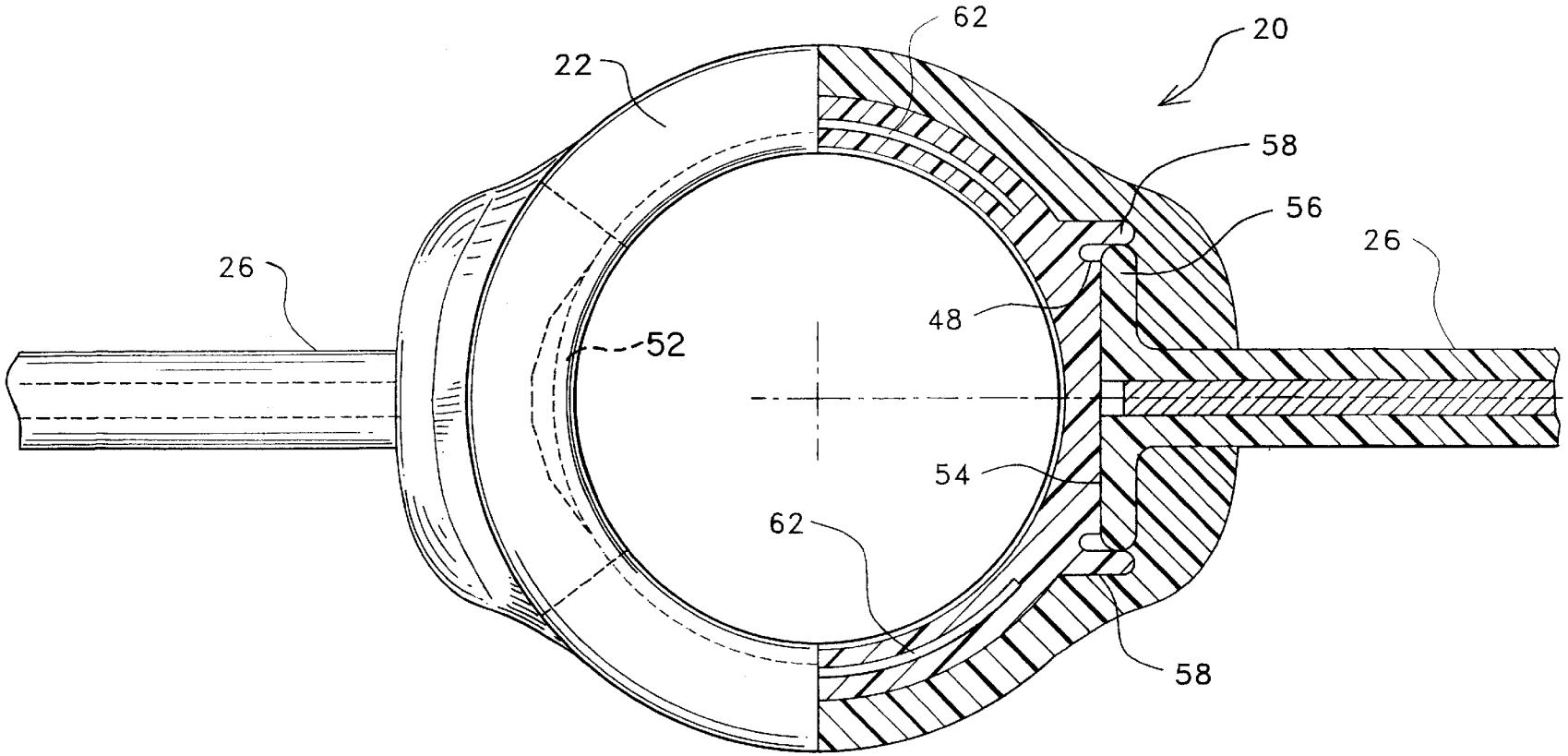
FIG. 7 is a side elevational view taken along line 7—7 of FIG. 6, partially in cross section, and showing the head of one leg in position against the tabs of the support collar within the hollow cylindrical body support for Y-axis rotation of a leg of the present invention.
Figure 8:
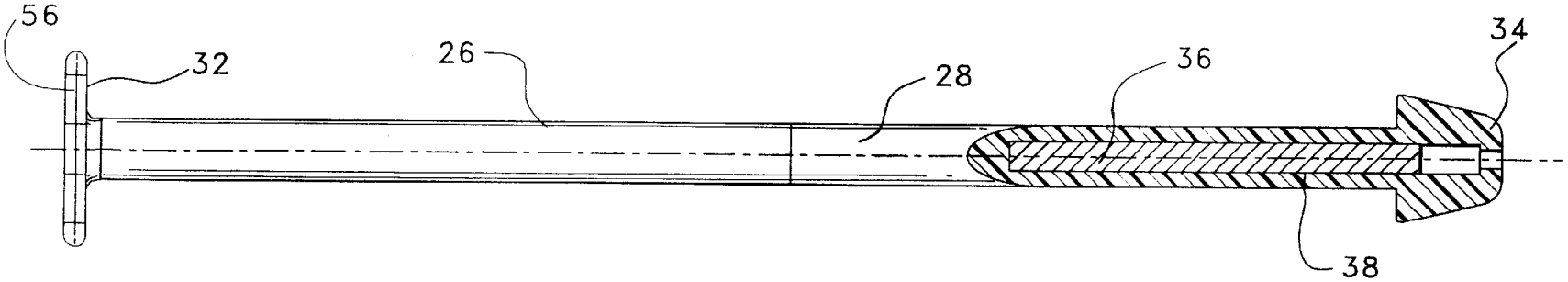
FIG. 8 is a side elevational view, partially in cross section, showing the location of a bendable metal brace within a leg which is a portion of the support system of the present invention.
Figure 9A:
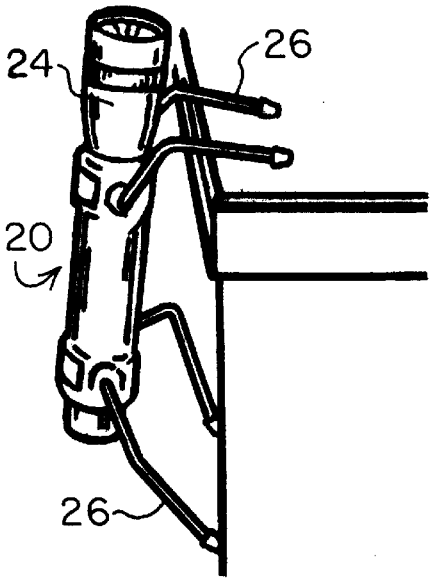
FIGS. 9*a*–9*g* show the support system of the present invention in various positions.
Figure 9B:
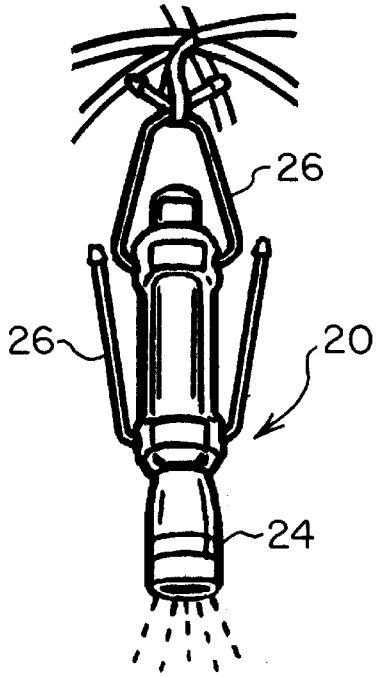
Figure 9C:
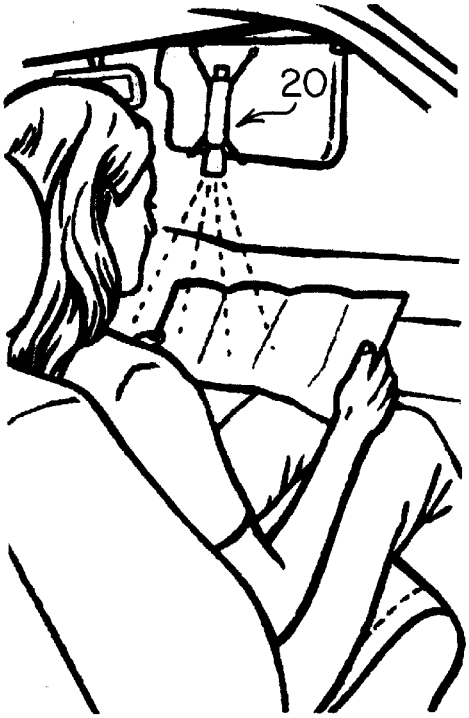
Figure 9D:
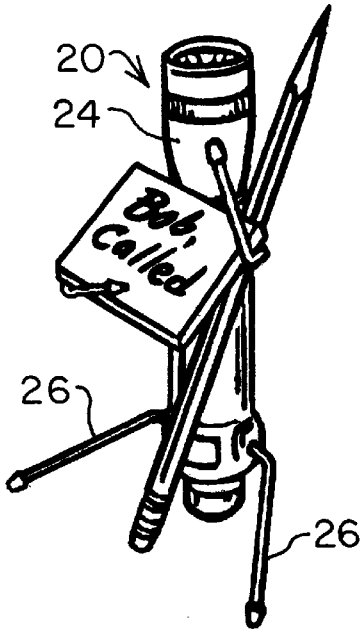
Figure 9E:
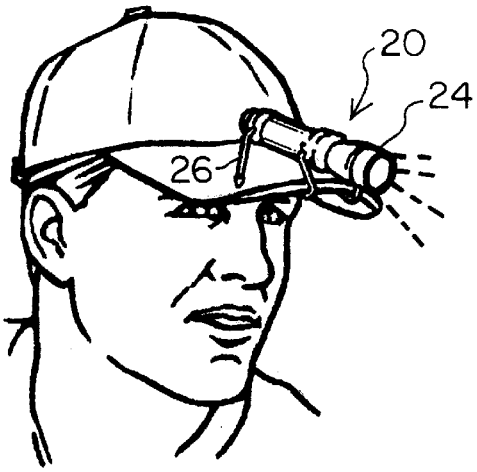
Figure 9F:
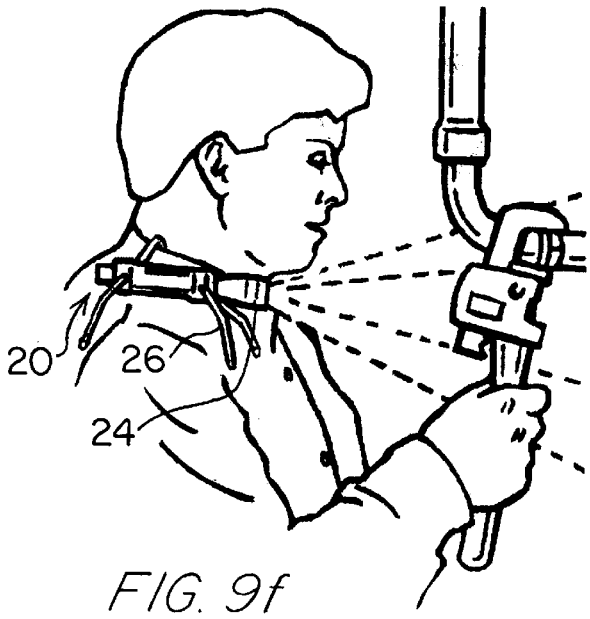
Figure 9G:
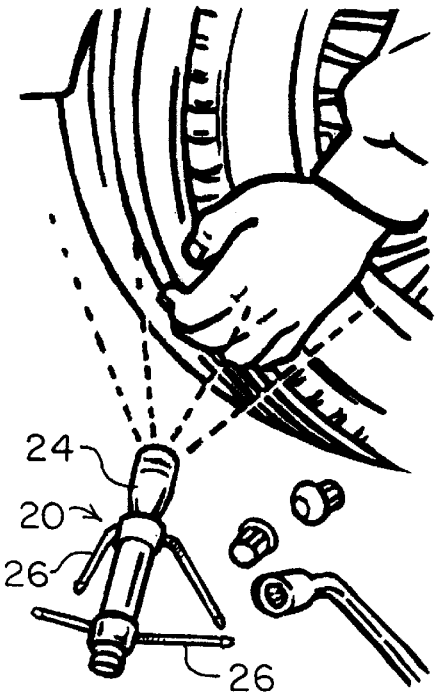

Now referring to FIGS. 4–8, additional details of flashlight support device 20 are shown. Each set of legs 26 includes a body portion 28, FIG. 8, which carries a polygonal head portion 32, and a foot portion 34, in preferred embodiments head portion 32 and foot portion 34 are integral with body portion 28. In preferred embodiments, body portion 28 is comprised of a wear resistant material, for example, polymeric thermoplastic nylon. As shown in FIGS. 4 and 8, body portion 28 is hollow, preferably carrying a polygonal cross section opening 36, in this case having a square cross section. Opening 36 is accessible through polygonal head 32. In preferred embodiments, located within each opening 36 is a bracing material 38 that is bendable, but which also provides strength to legs 26. As with opening 36, bracing material 38 is also polygonal, and in this case also has a square outer cross section. It has been found that the use of a polygonal opening 36 with a matching polygonal brace 38 provides a stable orientation between brace 38 and leg 26. That is, when leg 26 is bent, it does not tend to rotate with respect to the outer polymeric portion of leg 26. In use brace 38 is completely inserted within opening 36 of leg 26, and runs axially substantially the entire length of leg 26. In preferred embodiments, bracing material 38 is square 1008 low carbon steel wire, although any other metal, or shape retaining natural, or polymeric material may be substituted therefor. As a result, while the legs 26 are bendable and hold the desired shape and position in which the user places them, they are also very strong. This allows flashlight holder system 20 of the present invention, and the flashlight 24 which it carries to be positioned to shine, for example, from the substantially horizontal position shown in FIG. 3 to a substantially vertical position as shown in FIG. 9*a*, as well as at various other angles, or attached to various objects as shown in FIGS. 9*a* –9*c* and 9*e* and 9*f*. The forgoing not withstanding, the absence of any bracing material within legs 26 is within the scope of the present invention.

Hollow cylindrical body portion 22 is preferably comprised of a flexible material such as leather, rubber, fabric or polymeric material, with clear polyvinyl chloride being one preferred material. Hollow cylindrical body portion 22 carries one or two through holes 44 to receive legs 26 therethrough, while retaining polygonal heads 32 within its open hollow body, generally 46. In order to accommodate heads 32, hollow body portion 46 includes internal recesses 48, see FIGS. 5 and 7. With polygonal heads 32 within internal recess 48 of body portion 22, a retaining collar 52 is then inserted into open hollow body 46 and located to retain each head 32 in place within its recess 48.

Referring now to FIGS. 4, 6 and 7, it is seen that each collar 52 is cylindrical on the inside, and carries a pair of substantially flat, opposed outer support surfaces 54, which each support surface 54 bearing against the substantially flat proximal end 56 of adjacent head 32 of leg 26. Bracketing each support surface 54 is a pair of tab springs 58. Tab springs 58 are separated by a distance that is substantially equivalent to the diameter through the center of polygonal head 32 to a pair of opposed sides of the polygon. As a result, when the head 32 is within recess 48 and secured against a flat support surface 54, a pair of opposed polygonal sides of head 32 are normally retained in a stable position between tab springs 58. However, when each leg 26 is rotated in the Y-axis, the flexible nature of head 32 or tab springs 58 allows head 32 or tab springs 58 to either deform or move over center so that an adjacent pair of opposed polygonal sides of head 32 may also assume a stable position between tab springs 58. Rotation may proceed in any number of increments in either a clockwise or counter-clockwise direction. In the embodiment shown, polygonal head 32 has ten (10) sides, and therefore has ten (10) stable positions at incremental angles of about 36° of rotation in the Y-axis. It is of course clear that this system of rotation works most efficiently when polygonal head 32 has an even number of equilateral sides.

In preferred embodiments, collar 52 is normally rigid, but is deformable to the extent that if pressure is applied to it across its diameter, it will deform, and then return to its original shape, without either cracking or permanently deforming. One preferred material for use in forming collar 52 is transparent polycarbonate, which is deformable, but is also shatter resistant. Where head 32 is formed of nylon and collar 52 is formed of polycarbonate, since both materials have a high resistance to wear, and tend to provide low friction surfaces, both head 32 and collar tab springs 58 resist wear and have a long useful life. As detailed and shown below, each leg 26 can be rotated in ten (10) 36° increments in either direction for a total of 360°. It can be retained in any of the ten (10) incremental positions by the interaction of sides 56 of head 32 against tab springs 58 of collar 52.

As shown in FIGS. 4, 6 and 7, in preferred embodiments, collar 52 includes arcuate slots 62 into which labels 64 may be inserted. Labels 64 may carry trademark or trade name, or brand or grade or other information that allow the manufacturer/distributor to label the support system in an inexpensive, but permanent manner. In order to avoid damage to labels 64, slots 62 are first sealed by the O-ring type fit between the inner surface of body 22 and slots 62. They may be further sealed with a waterproof material, such as silicone sealant, in order to retain labels 64 in place while also sealing slots 62 so that water and other liquids cannot enter slots 62 and damage labels 64.

It can therefore be seen that the versatile flashlight holder system 20 of the present invention expands the use of flashlight 24. As shown by reference to FIGS. 3, 9*a*–9*g*, it frees a users hands, for example, allowing the user to support and aim the flashlight from any surface to be shined at any angle or in any direction, attach the system to any support, including the user's belt, shirt, hat or other article of clothing. It allows the user to use one or more legs 26 to hang the system 20, including flashlight 24, in any convenient accessible location of preference by adjusting the angles of the legs 26 as desired. its uses are limited only by the imagination of the user. In addition, system 20, and especially body portion 22, protects the body of the flashlight 24, and also provides a surface that can be gripped more securely than the body of the flashlight itself. Where the body portion 22 is clear or translucent, it enhances the visibility of the flashlight color, logo, trademark or other flashlight design feature. Nevertheless, system 20 is easily removed from or placed on the body of flashlight 24.

Figure 10:
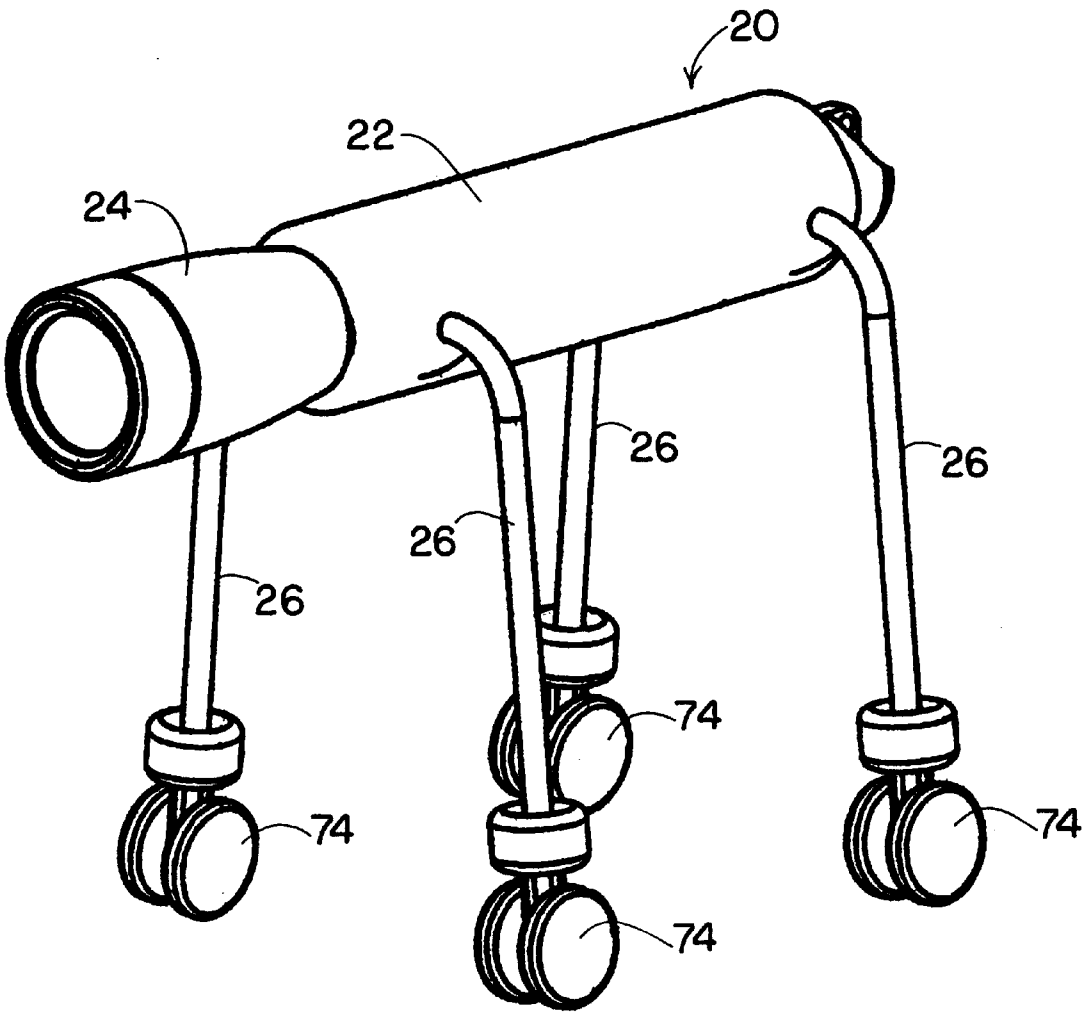
FIG. 10 shows an alternative embodiment of the support system of the present invention in which the legs terminate in rollers.
Figure 11:
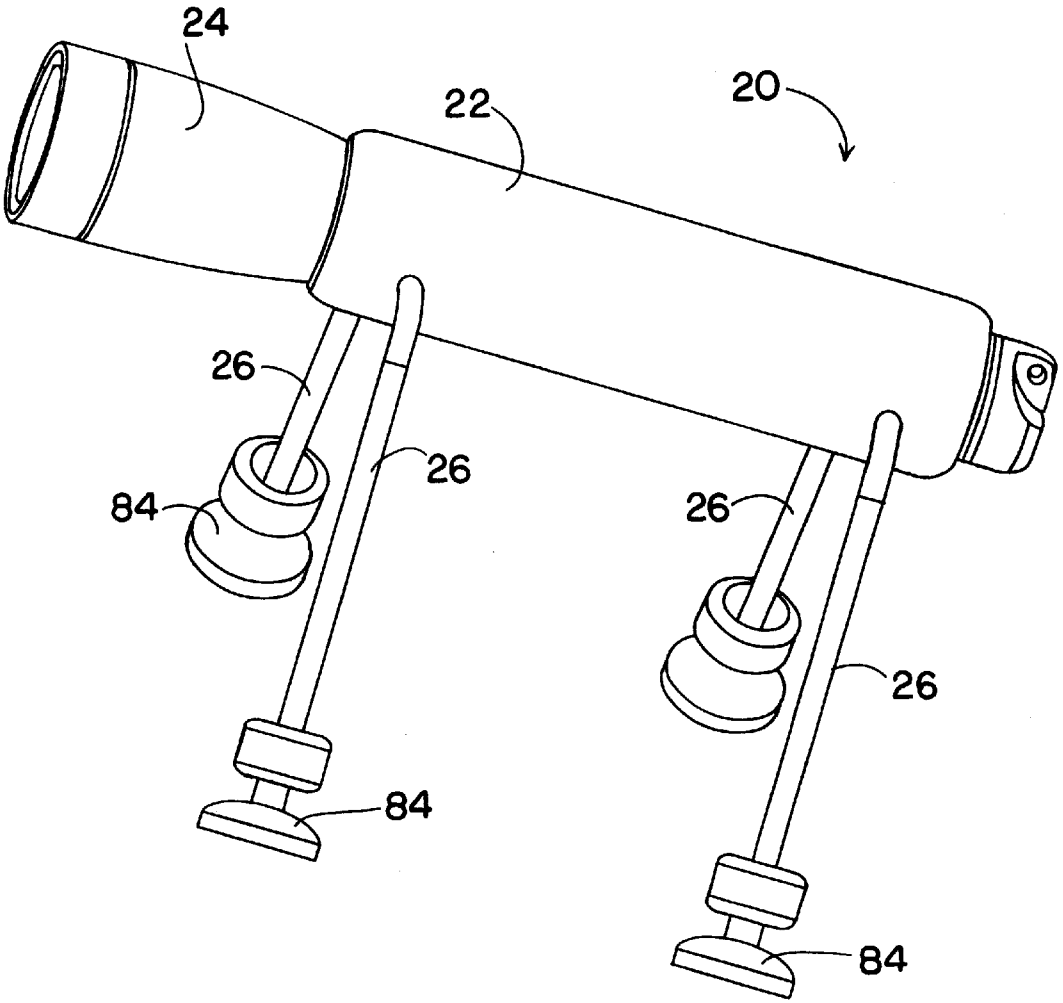
FIG. 11 shows an alternative embodiment of the support system of the present invention in which the legs terminate in enlarged pads which may be suction cups, or hoop and loop materials, or which may be magnetic elements.

Referring to FIGS. 10, there is shown an alternative embodiment of the support system 20 of the present invention in which the legs 26 terminate in rollers 74. Similarly, referring to FIG. 11, there is shown another alternative embodiment of the support system 20 of the present invention in which the legs 26 terminate in an enlarged pad 84. Pad 84 may either be a pad, a suction cup or may carry a magnetic. The utility of the embodiment in FIGS. 10 and 11, or of any other modified foot of leg 26 is apparent, and again, the variations to the foot are only limited by the imagination of the manufacturer. While the end of the leg may be formed into a hook, see FIGS. 9*a* and 9*d*, it need not be in the form of a hook in order to function.

Figure 12:
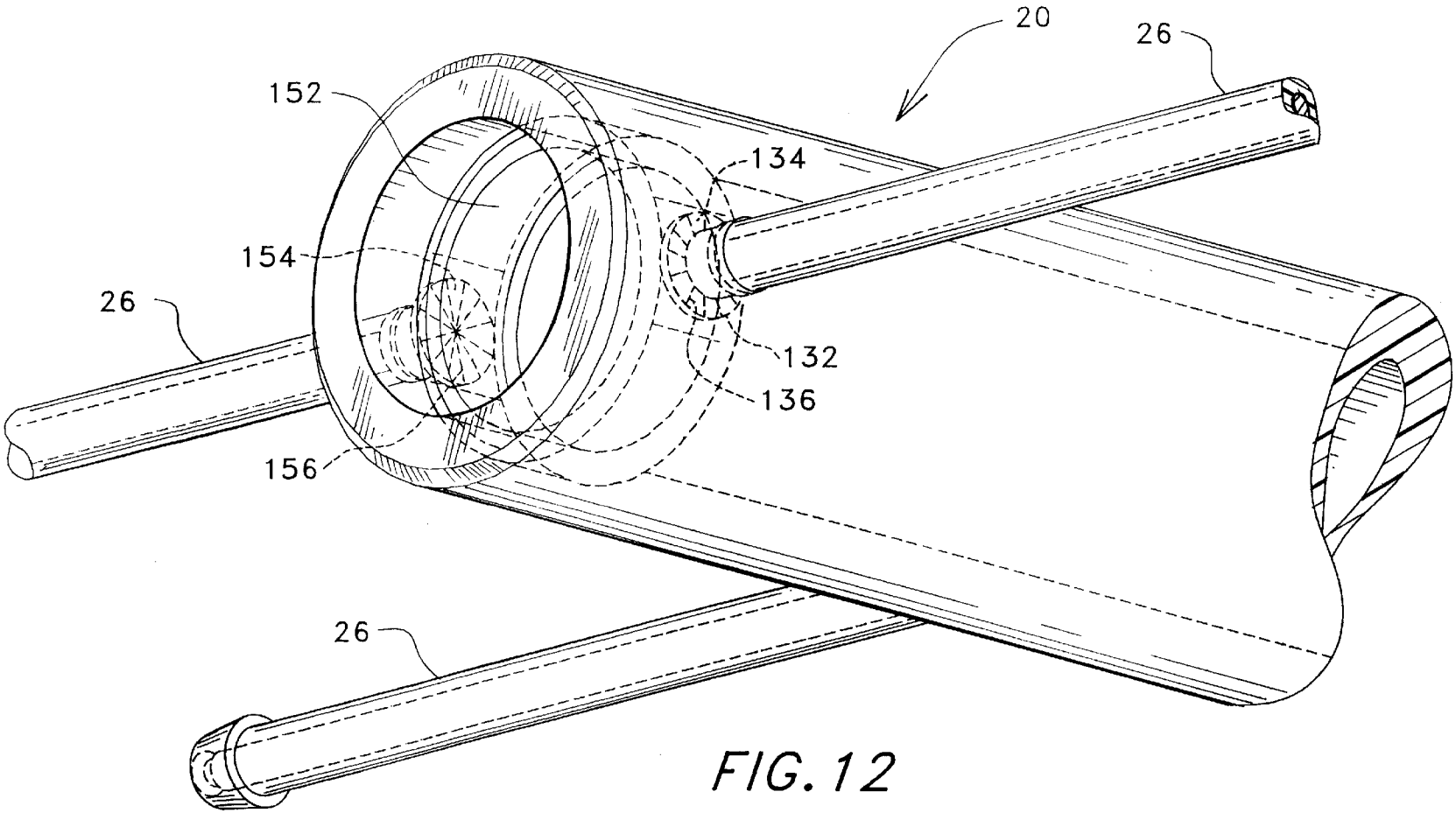
FIG. 12 shows an alternative mechanism for Y-axis rotation of the base of a leg within the hollow cylindrical body of the support system of the present invention.

FIG. 12 shows the details of one alternative mechanism for connecting and positioning the base of a leg 26 for rotation in the Y-axis within the cylindrical body 22 of the support system 20 of the present invention. More specifically, as shown, modified head 132 of leg 26 carries a plurality of radially extending wedges 134 and grooves 136 spaced around its surface. Collar 152 carries a plurality of similarly sized and shaped complimentarily wedges 154 and grooves 156 radially around its surface. Wedges 154 and grooves 156 are located to receive and mate with wedges 134 and grooves 136 of modified head 132. As a result, the series of wedges 134 and grooves 136 carried by head 132 are normally retained in a stable position against wedges 154 and grooves 156 of collar 152. However, as with the previously described embodiment, when legs 26 are rotated in the Y-axis, wedges 134 and grooves 136 of head 132 move over center with respect to wedges 154 and grooves 156 of collar 152. This allows head 132 and attached leg 26 to assume a plurality of stable incremental positions in the Y-axis. In the embodiment shown, head 132 has about twenty (20) pairs of wedges 134 and grooves 136 which intersect with a similar number of wedges 154 and grooves 156 carried by collar 152. This embodiment therefore has twenty (20) stable positions at incremental angles of about 18° of rotation in the Y-axis.

Figure 13:
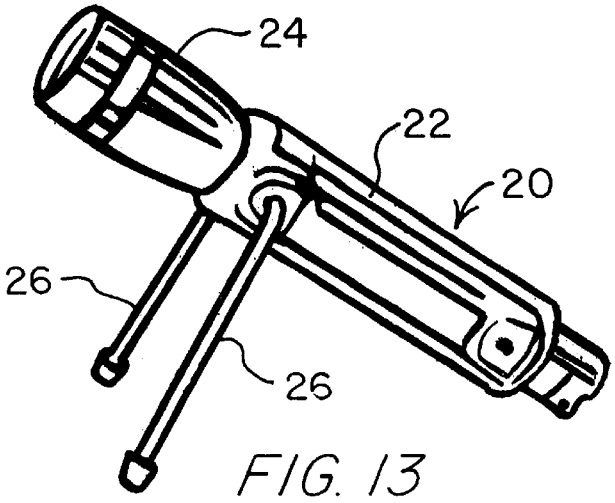
FIG. 13 shows an alternative embodiment of the support system of the present invention in which there are only two legs which are located adjacent to the head of a flashlight.

In the alternative embodiment shown in FIG. 12, collar 152 is also normally rigid, but is deformable to the extent that if pressure is applied to it, it will deform, and then return to its original shape, without either cracking or permanently deforming. One preferred material for use in forming collar 152 is transparent polycarbonate, which, is noted above, is both deformable and shatter resistant. Where head 132 is formed of nylon and collar 152 is formed of polycarbonate, since both materials have a high resistance to wear, and tend to provide low friction surfaces, both head 132 and collar 152 resist wear and have a long useful life Referring now to FIG. 13, it shows an alternative embodiment of the support system 20 of the present invention in which there are only two legs 26 which are located adjacent to the head of a flashlight 24 carried by support device 20, with the rear end of flashlight 24 forming a stable tripod with legs 26. As in the other embodiments, legs 26 are both rotatable in the Y-axis and bendable in the X and the Z-axis so that support device 20 of FIG. 13, and therefore, flashlight 24 can be positioned in substantially any orientation to point the beam of light were it is needed.

Figure 14A:
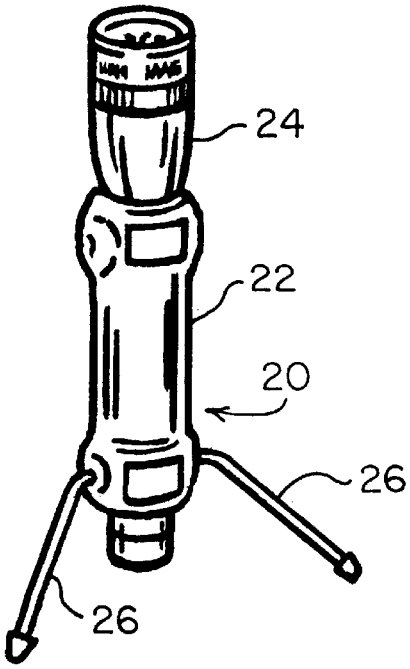
FIGS. 14*a* and *b* shows an alternative embodiment of the support system of the present invention in which there are only two legs which are located adjacent to the rear of a flashlight.
Figure 14B:
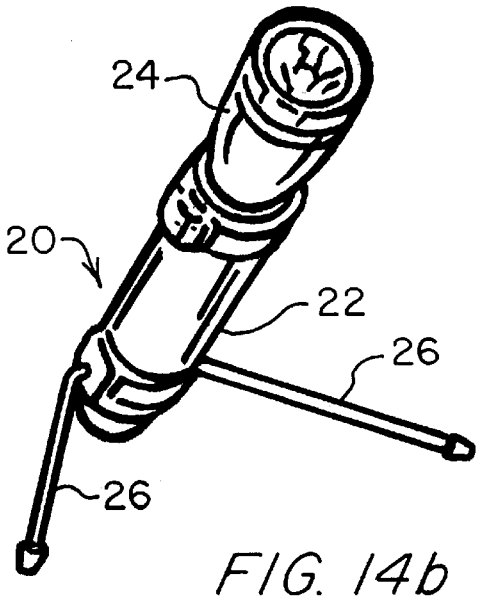

Similarly, FIG. 14 shows another alternative embodiment of the support system 20 in which there are only two legs 26 which in this case are located adjacent to the front end of a flashlight 24, with the end of flashlight 24 forming a stable tripod with legs 26. As in the other embodiments, legs 24 are both rotatable in the Y-axis and bendable in the X and the Z-axis so that support device 20 of FIG. 14, and therefore flashlight 24 can be positioned in substantially any orientation to point the beam of light were it is needed.

Figure 15:
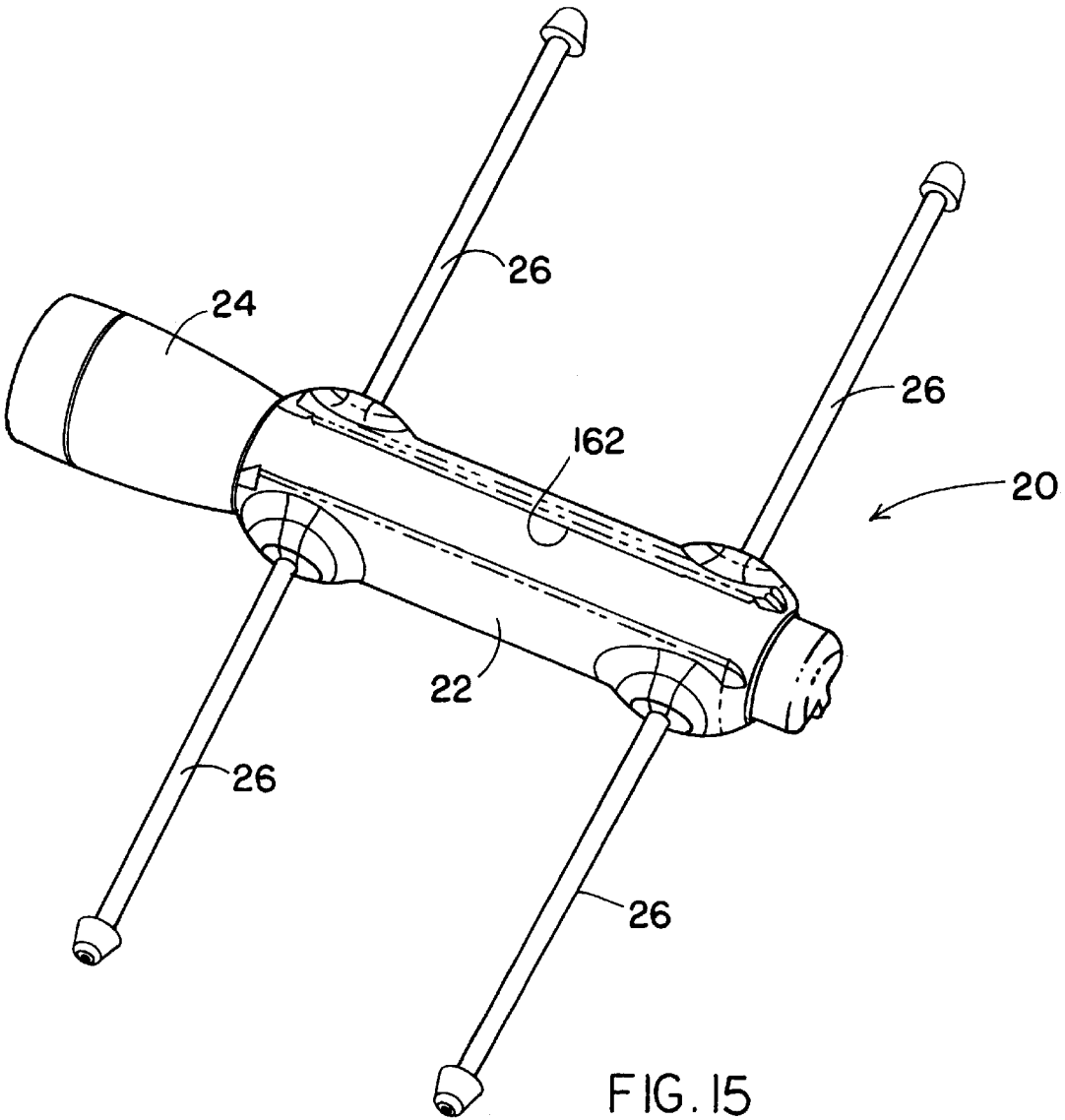
FIG. 15 shows another alternative embodiment of the support system of the present invention in which the within the hollow cylindrical body of the flashlight support includes an open axial seam.

FIG. 15 shows yet another alternative embodiment of the support system 20 in which the hollow cylindrical body 22 includes an open seam 162 that runs the entire axial length of cylindrical body 22. This allows a user to place support system 20 on flashlight 24 on, or to remove support system 20 from flashlight 24, both without the need to move flashlight 24 within a closed, solid, tight cylindrical body 22.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A flashlight support device including:

a hollow open body having an axial length dimension and a first and a second end, at least one said end being open, said hollow open body designed and dimensioned to removably receive the body of a flashlight within said open end;

at least one pair of leg receiving means carried by said hollow open body, each said leg receiving means of said pair being at substantially the same axial length position on said hollow open body, each said leg receiving means of said pair of leg receiving means being spaced apart from each said other leg receiving means of said pair at least one pair of adjustable and bendable legs, each leg of said pair being carried by one of said leg receiving means of said at least one pair of leg receiving means, each leg of each pair being separate from each other leg of the same pair of legs, at least one leg of said pair being rotatable with respect to said leg receiving means in a Y-axis, each said leg being comprised of a bendable material and capable of being manually bent, without any additional mechanism, into substantially any stable position and configuration in the X and Z-axis.

2. The flashlight support device of claim 1 wherein said leg receiving means and said adjustable and bendable legs are designed to allow each rotatable and bendable leg to be rotated into a number of incremental positions in the Y-axis.

3. The flashlight support device of claim 2 wherein said leg receiving means and said adjustable and bendable legs attached thereto allow each rotatable and bendable leg to be rotated into a number of incremental positions over a range of a full 360° in the Y-axis, and bent into substantially any stable position and configuration in the X and Z-axis without any additional mechanism.

4. The flashlight support device of claim 2 wherein said hollow open body has two opposed open ends, and there are at least two pairs of adjustable and bendable legs, each leg being attached to said hollow body by leg receiving means for rotation of each leg in the Y-axis with each leg of each pair of legs located in substantially diametric opposition to its paired leg, each pair of legs being adjacent to one said open end of said hollow open body, said legs being comprised of a bendable material and capable of being bent, without any additional mechanism, into substantially any position and configurations in the X and Z-axes.

5. The flashlight support device of claim 1 wherein each of said legs includes a body portion comprised of a bendable material which will maintain its shape when bent, said body portion.

6. The flashlight support device of claim 5 wherein each said leg portion includes an internal bendable bracing element that will also maintain its shape when bent.

7. The flashlight support device of claim 6 wherein said leg includes a hollow portion having a polygonal cross section, and wherein said bracing material has a complimentary polygonal cross section, whereby, when said leg is bent said body portion of said leg resists rotating with respect to said bracing element within said leg.

8. The flashlight support device of claim 7 wherein said polygonal cross section of said hollow portion of said leg and said polygonal cross section of said bracing material are both square, whereby, when said leg is bent said body portion of said leg does not tend to rotate with respect to said square bracing element within said leg.

9. The flashlight support device of claim 5 wherein said open hollow body has a leg receiving opening for each said leg, each said leg extending through said leg receiving opening with said head of said leg located within said open hollow body for rotation in the Y-axis, and a retaining collar is provided, said retaining collar being located and positioned within said open hollow body to retain and support each head of each leg through said open hollow body.

10. The flashlight support device of claim 9 wherein said retaining collar and said head of said leg are included in said rotation means for said head of said leg in the Y-axis ,said collar including a pair of opposed outer support surfaces which individually bear against an individual head of one leg.

11. The flashlight support device of claim 10 wherein said head portion of each said leg is in the shape of a polygon having a given diameter through its center head between a pair of opposed flat sides and a substantially flat face, wherein further said outer support surfaces of said retaining collar includes a pair of tab springs which bracket said support surface and which are separated by a distance that is substantially equivalent to the diameter through the center of said polygonal of said polygonal head, whereby when said polygonal head is located between said tab springs and against said outer support surface of said collar with a pair of opposed flat sides of said polygonal head between said tab springs, said polygonal head of said leg is retained in a stable position between said tab springs, and is rotatable in increments to other stable positions in the Y-axis.

12. The flashlight support device of claim 10 wherein said head portion of each said leg carries a plurality of alternating radially extending wedges and grooves spaced around its surface, and wherein said collar carries a plurality of similarly sized and shaped complimentarily alternating radially extending wedges and grooves around its surface which are located to receive and mate with said wedges and grooves of said head of said leg, whereby said wedges and grooves carried by said head are normally retained in a stable position in the Y-axis against said wedges and grooves carried by said collar, and said head is rotatable in increments to other stable positions in the Y-axis.

13. The flashlight support device of claim 1 wherein said system includes one pair of said adjustable and bendable legs.

14. The flashlight support device of claim 1 wherein said system includes two pairs of said adjustable and bendable legs.

15. The flashlight support device of claim 5 wherein said foot portion of said leg includes a mechanism selected from the group including wheels, pads, magnets, suction cups, and hook and loop material.

16. The flashlight support device of claim 1 wherein said hollow body portion includes an open axial seam for ease of placing and removing a flashlight from within said hollow body portion.

17. The flashlight support device of claim 9 wherein at least one said retaining collar includes at least one slot.

18. The flashlight support device of claim 17 wherein indicia in the form of a label is located in said at least one retaining collar slot.

19. The flashlight support device of claim 18 wherein said at least one retaining collar slot is sealed so that indicia located within said slot is retained in place and protected from damage.

* * * * *